United States Patent [19]

Briard et al.

[11] Patent Number: 4,521,196

[45] Date of Patent: Jun. 4, 1985

[54] METHOD AND APPARATUS FOR FORMATION OF A FICTITIOUS TARGET IN A TRAINING UNIT FOR AIMING AT TARGETS

[75] Inventors: René Briard, Orgeval; Christian Saunier, Ermont; Guy Canova, Marly-le-Roi, all of France

[73] Assignee: Giravions Dorand, France

[21] Appl. No.: 386,778

[22] Filed: Jun. 9, 1982

[30] Foreign Application Priority Data

Jun. 12, 1981 [FR] France ..... 81 11574

[51] Int. Cl.[3] ..... G09B 9/00

[52] U.S. Cl. ..... 434/20; 434/43

[58] Field of Search ..... 434/43, 20

[56] References Cited

U.S. PATENT DOCUMENTS

| | | | |
|---|---|---|---|
| 3,327,407 | 6/1968 | Barnes | 434/43 |
| 3,401,228 | 9/1968 | Barnes | 434/43 |
| 3,711,826 | 1/1973 | La Russa | 434/43 |
| 3,725,563 | 4/1973 | Woycechowsky | 434/43 |
| 4,001,499 | 1/1977 | Dowell | 434/43 |
| 4,068,393 | 1/1978 | Tararine et al. | 434/20 |
| 4,246,605 | 1/1981 | La Russa | 434/20 |

*Primary Examiner*—Richard C. Pinkham
*Assistant Examiner*—Leo P. Picard
*Attorney, Agent, or Firm*—Cantor and Lessler

[57] ABSTRACT

In a training unit for aiming at fictitious targets as applicable in particular to a firing simulator, provision is made for an optical sighting device in which the line of sight from reticle image to target is orientable at least at the start of a fictitious-firing event. Target signals define successive images of a fictitious target as a function of the shape and continuous relative displacement of the target at least in distance from the training unit and/or in angular position with respect to the line of sight. Each successive target image is formed by means of a luminous point moving on a screen, the successive images thus formed being projected in the field of view of the sighting device.

10 Claims, 5 Drawing Figures

METHOD AND APPARATUS FOR FORMATION OF A FICTITIOUS TARGET IN A TRAINING UNIT FOR AIMING AT TARGETS

This invention relates to training units for aiming at targets and more particularly to units for firing practice. Firing simulators are employed for instruction and training of firing personnel in aiming weapons at targets either in a room or under real field conditions but without expending live ammunition. Thus a fictitious projectile is employed whilst a computer serves to compare the position of the projectile with a target in order to appreciate the quality of the aim directed by the firer at the target and in particular to determine whether a shot has been correctly "fired" to bring the simulated projectile to impact on the target. The target itself can be either real or fictitious. As far as the projectile is concerned, it is a known practice to simulate in this manner the firing of both missiles and simple ballistic-trajectory projectiles. In the case just mentioned, the trajectory of the fictitious projectile is predetermined as a function of ballistic data whereas in the case of missiles, the trajectory is modified by orders which are internal to the missile or delivered by the weapons system and reconstituted in the simulator computer.

In accordance with conventional practice, firing simulators are also provided with means for visual display of luminous images observed by the firer and superimposed on the firing field or range observed by means of a sighting device integrated with the weapon. The luminous images show the trace or path of a missile, indicate a target or display the results of a shot fired, especially by means of the effects of an impact. However, the means proposed for this purpose up to the present time still remain very imperfect since they never amount to anything more than simple and stationary lighting effects, the image of which is projected in the field of the sighting device.

The object of the invention is to improve the performances of known equipment in the field of weapon-firing simulation and in particular to permit firing exercises on targets which are fictitious but realistic both in shape and in continuous relative displacement in time, even during aiming and firing. This principle of simulation dispenses with the need to use real targets for training personnel in aiming at targets, either in the simulation of combat firing or in any other application of analogous aiming exercises.

To this end, the invention proposes a method of formation of a fictitious target in a training unit for aiming at targets, provision being made for an orientable line of sight such as the optical sighting device of a firing simulator which is orientable at least at the start of a fictitious-firing event. Said method essentially consists in producing target signals defining successive images of a fictitious target as a function of the shape and continuous displacement at least in distance from the training unit and/or in angular position with respect to the line of sight, in forming each successive target image thus defined by means of a luminous point which is displaced on a screen under the control of target signals during the time of retention of retinal images, and in projecting the successive images thus formed in the field of view of the sighting device.

The screen can be in particular the screen of a cathode-ray tube. In a more general manner, however, any other system for visual display of geometrical figures on a screen controlled by electronic methods would be suitable.

Preferably, the method according to the invention is further distinguished by the fact that each target image is defined in said target signals by at least one linear segment and that displacement of the point is controlled as a function of said target signals along a linear path comprising at least said segment with a continuous light intensity along said segment.

The linear path can follow any curves and can be continuously followed by a luminous point whose light intensity is continuous while describing the complete target path at each image. This is understood to mean that the light intensity may be continuous but is not necessarily constant. On the contrary, it is possible by varying the light intensity to obtain shape effects within each image or distance effects from one image to another. Moreover, the linear path can be provided with extinction segments in which the luminous point is extinguished so that said segments are not apparent in the image, for example when passing to the following image or between two segments showing different parts of the target. The preferential mode of displacement of the luminous point which has been defined along a linear path is carried out in particular by making use of a cathode-ray tube of the flying-spot type in contradistinction to scanning tubes in which the luminous point scans the entire screen in rectangular coordinates with extinction outside the zones covered by the image.

A particular case of the linear path is that of a path constituted by one or a number of rectilinear segments. This is particularly advantageous in the practical application of the invention by reason of the fact that, in the target signals, any rectilinear segment can be defined with great simplicity in a system of two rectangular coordinates by the length of the segment and its angle of slope. If necessary, the signals may contain an item of intensity information for controlling variations in light intensity and in particular for controlling extinction of the luminous point on its path from one to the other of two segments to be displayed as constituent segments of the target image. It is readily apparent that the juxtaposition of elementary segments serves to form any desired curves. It is also apparent that the term "target" must be understood in a broad sense considered as including a representation of a number of targets which can be displaced continuously and independently of each other.

The good resolution obtained by means of this technique permits of accurate and faithful representation of the shape of a target and bears a strong resemblance to a real target. Furthermore, the speed attainable in the displacement of the luminous point and in the rate of production of images makes it possible to display the continuous travel even of a highly mobile target during the real viewing time and during simulation of a fired shot, for example. Results such as these would be difficult to obtain in practical simulation of fired shots if it were sought, for example, to project into the field of view of the sighting device the photographic reproduction of a real target instead of the fictitious target which, in accordance with the invention, is entirely synthesized by electronic means.

In conjunction with the method defined in the foregoing, a further object of the invention is to provide a training unit for the practical application of the invention which consists in aiming at targets. Said unit is advantageously constituted by an optical sighting device mounted for example on a weapon for aiming and firing a fictitious projectile in a firing simulator. The simulator comprises means for forming a fictitious target in the field of view of the sighting device and means for making a comparison between the respective positions of the fictitious projectile and the fictitious target in order to appreciate the results of the fired shot.

According to the invention, the training unit which serves to aim and fire at a target with an orientable line of sight comprises means for forming a fictitious target in the field of view of said unit and is distinguished by the fact that said target-forming means comprise a screen for visual display of luminous images, means for generating target signals in order to produce target signals defining successive images of a non-pointlike target as a function of its shape and continuous displacement at least in distance from the unit and/or in angular position with respect to the line of sight. The aiming unit further comprises means for causing the displacement of a luminous point on the screen by means of said signals in order to display each of the images thus defined on said screen, and means for projecting the image thus formed in the field of view of the unit.

A more complete description of the invention will now be given with reference to a particular embodiment of a weapon-aiming training unit for the practical application of the method according to the invention for forming a fictitious target in a firing simulator. This particular embodiment is given without implying any limitation of the invention, however, and is described with reference to the accompanying drawings, wherein.

The firing simulator according to the invention is so designed as to permit appreciation of the results of firing of fictitious projectiles at targets which are themselves fictitious. In accordance with wholly conventional practice, the simulator comprises a weapon for aiming and firing which is adjusted by the operator for correct orientation with a view to ensuring that the shot reaches the target. The simulator further comprises means for making a comparison between the respective positions of the fictitious projectile and the target in order to appreciate the results of the shot fired and in particular to determine whether the trajectory of the projectile is such as to produce an impact on the target. This comparison is carried out in practice by means of a computer which processes positional data including angular differences in elevation and in azimuth with respect to a reference axis and the distance with respect to the weapon. Assuming that the projectile follows a ballistic trajectory, its angular position is determined at the moment at which its distance from the weapon is equal to that of the target according to the aim taken at the moment of firing and according to pre-recorded ballistic data irrespective of subsequent displacements of the weapon while the projectile follows its trajectory. It is also possible, however, to simulate firing of projectiles which are assumed to consist of missiles, in which case the computer provides projectile-position data while taking into account the inherent reactions of the missile or displacement of the weapon with which the telescopic sight is associated.

Figure 1:
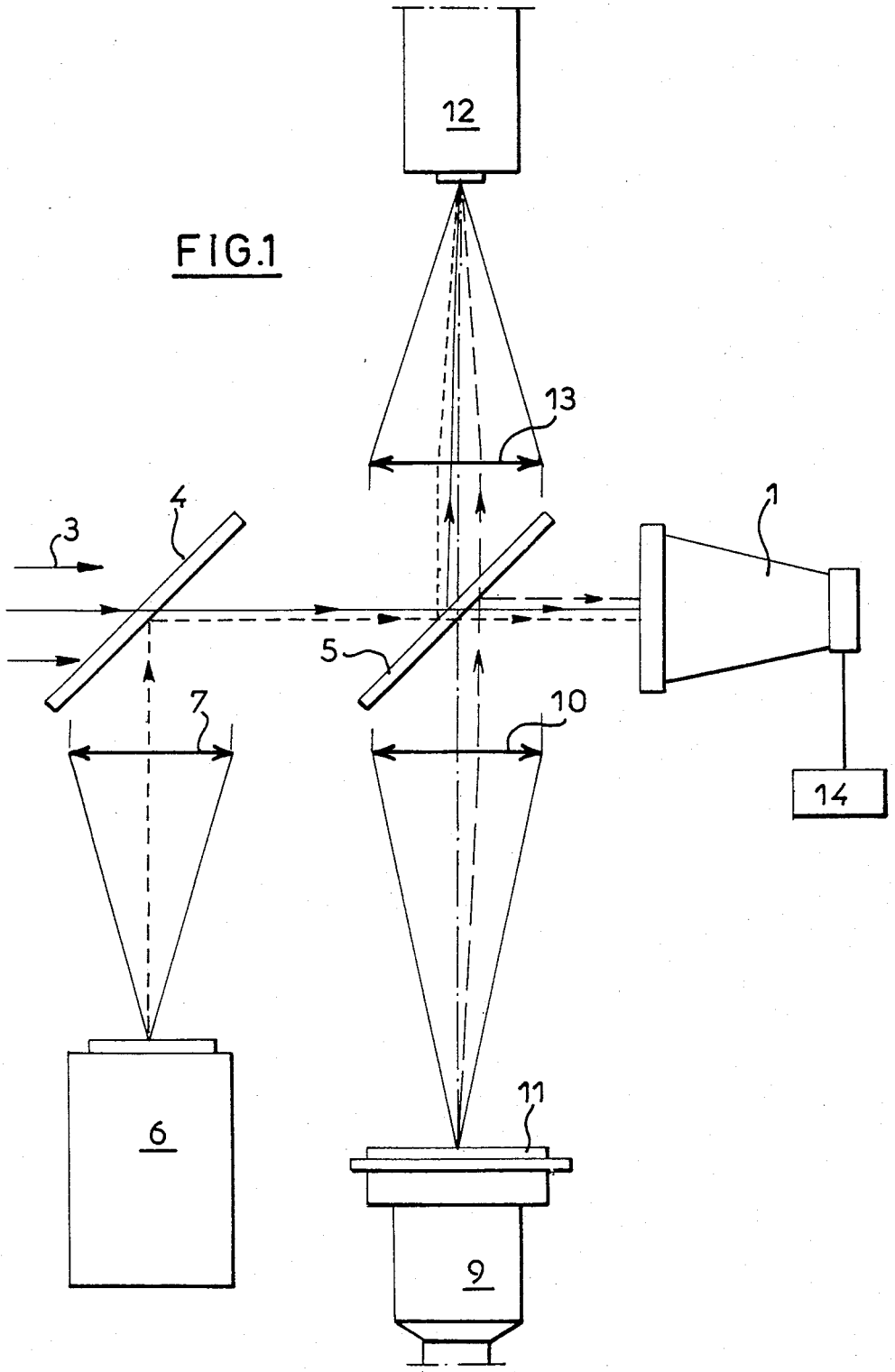
FIG. 1 is a schematic representation of the optical portion of the firing simulator.
Figure 2:
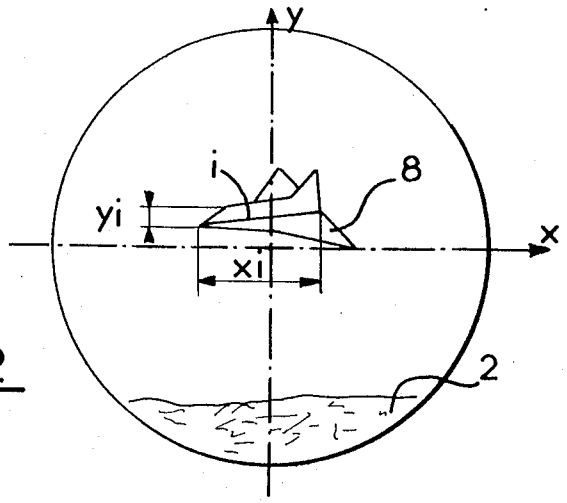
FIG. 2 illustrates one example of the images which can be presented for viewing by the firer.

In accordance with FIG. 1, the optical devices of the firing simulator comprise a sighting device 1 which can consist in particular of a telescopic sight mounted on the firing weapon in rigidly fixed relation or an optical sighting system integrated with the weapon. In the field of view of said telescopic sight, the firer sees the battlefield landscape 2 (as shown in FIG. 2), the rays 3 of which (shown in FIG. 1) are transmitted to the firer via two semitransparent plates 4 and 5. In the particular example considered, attenuation of luminosity across said plates is successively 20% and 50%. If the sighting device 1 is not provided with a reticle (or graticule) for marking the line of sight, a reticle generator 6 can accordingly be employed for reflecting the image of a sighting cross formed through a lens 7 by reflection from the semitransparent plate 4 in the field of view of the sighting device 1 in superimposition on the field of fire under observation. The reticle always remains centered on the optical axis of the sighting device.

In order to cause a fictitious target such as the target 8 of FIG. 2 to appear in the same field of view of the sighting device 1, the simulator is provided with a cathode-ray tube 9 associated with a lens 10 which makes it possible by reflection from the semitransparent plate 5 to return to the sighting device an image formed on the screen 11 of the cathode-ray tube of the flying-spot type. In other words, the desired target image is formed on the screen by displacement of the luminous point along a linear path and not by scanning.

There is also shown in FIG. 1 an optional equipment of the simulator which consists of a television camera 12 associated with a lens 13 and placed opposite to the tube 9 on the other side of the semitransparent plate 5 so as to receive in superimposed relation the image of the real landscape and the image of the reticle by reflection from the plate 5, and the target image by transmission through said plate. It is apparent from the figure that the two plates 4 and 5 are inclined at 45 degrees to the optic axis of the sighting device and that the reticle generator 6, the cathode-ray tube 9 and the camera 12 are oriented at right angles to said axis. The camera 12 consequently makes it possible to produce a reference film of firing exercises carried out by means of the simulator.

A further point worthy of note is that it would be possible in the case of indoor exercises to form the image of a landscape in the field of view of the sighting device by projection from photographic reproductions, for example.

The firing simulator is so designed as to be capable of displacing the fictitious target with respect to the landscape and if necessary to be capable of producing a similar displacement of the simulated path of the projectile within the field of view and to show impact effects in positions which are related to the landscape or to the target but must be independent of the movements of the sighting device. Since the reference axis chosen for all these simulations coincides with the line of sight, the simulator comprises a device for detecting movements of the weapon as designated in the figure by the reference numeral 14. This subsequently makes it possible to separate these movements from the position of the simulated projectile and target effects seen through the sighting device. The detection device is constructed in accordance with any suitable design known per se and may accordingly consist of a gyroscope or a gyrometer, for example, or of two accelerometers which provide compensation in elevation and in azimuth or of two angular position detectors (respectively in elevation and in azimuth) if the weapon is placed on a fixed platform anchored to the ground. The device can be provided in addition with a weapon tilt detector for producing an angular rotation about the line of sight in order to maintain the vertical plane.

Figure 3:
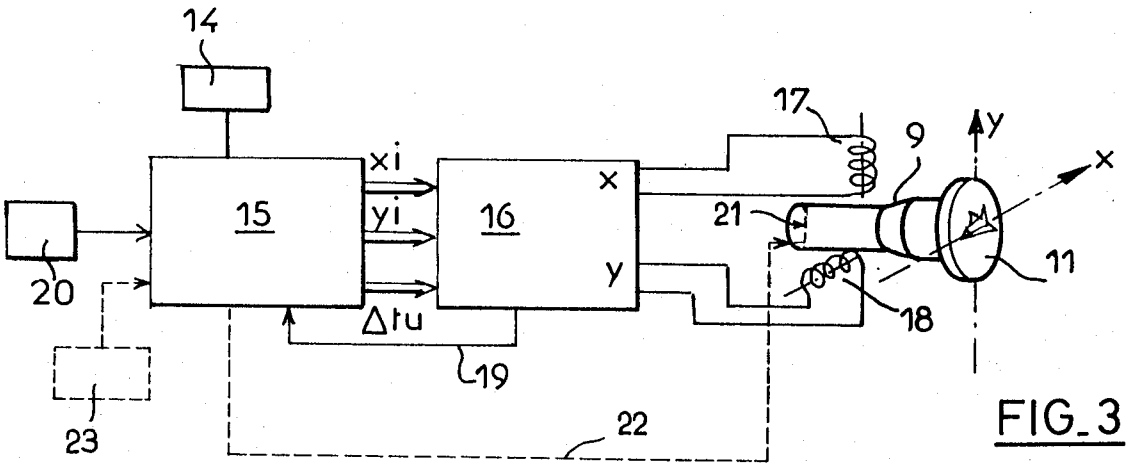
FIG. 3 is a schematic illustration of the electronic devices employed for the formation of the fictitious target.

In the description which now follows, consideration will be given more precisely to the manner in which the target images are formed on the screen 11 of the cathode-ray tube 9 (with reference to FIG. 3). The first general remark is that the displacement of the luminous point on the screen takes place at a predetermined constant speed which is sufficient to ensure that the time required for forming each target image is shorter than the time of persistence of retinal images. Furthermore, the target images are caused to follow each other in succession on the screen at a sufficiently high rate with respect to the image retention of the screen in order to ensure luminous persistence on the screen from one image to the next. In one particular example, the target images are formed on the screen at a rate of one image per twenty milliseconds.

These different images are defined by target signals generated by a microprocessor computer 15. The signals are produced within said computer from data introduced at 20 for defining the shape and motion of the target and from data relating to the movements of the sighting device delivered by the detection device 14.

The path of the luminous point on the screen is made up of a series of successive linear segments. On this path, the fictitious target is represented by a predetermined number of said rectilinear segments along which the point undergoes displacement while retaining a continuous light intensity. There is thus shown in FIG. 2 a complete set of segments constituting a target image having the profile of an aircraft.

In the case of each segment i of each image, the target signals produced by the computer 15 contain data in which the length of the segment is represented by the time of displacement of the luminous point in order to describe said segment and in which the angular slope of said segment is represented by the time derivatives of two rectangular coordinates x and y which define the position of the luminous point. Thus, said signals contain information relating more specifically to the rate of displacement of the luminous point along the x-axis, namely $x'_i$, to the rate of displacement of said point along the y-axis, namely $y'_i$, and to the time-duration of generation of the segment i, namely $\Delta t_i$.

The signals of these three groups are transmitted to an interface 16 which delivers the control signals to the cathode-ray tube 9. These signals control the current intensities through the windings 17 and 18 which serve to deflect the electron beam within the cathode-ray tube 9, respectively along the x-axis and along the y-axis. In the case of each segment i, said signals are obtained in the interface 16 respectively by integration of $x'_i$ and by integration of $y'_i$ during the time interval $\Delta t_i$. A line 19 retransmits from the interface to the computer a signal for indicating the end of the time interval $\Delta t_i$ assigned for the formation of a segment i; the computer can then transmit the values $x'_i$, $y'_i$ and $\Delta ti$ corresponding to the next segment. While the interface 16 controls the displacement of the luminous point along each segment as a function of the target signals, the computer 15 produces the signals corresponding to the following target image according to the position of the aircraft in space (orientation, rolling motion, pitching motion, speed and trajectory which have been assigned thereto) while taking into account any possible displacements of the weapon.

The solution described in the foregoing has an advantage in that the computer need produce only three values at a given instant in the case of each segment, with the result that the computer is permitted for most of the time to compute the future position of the target while the segments are recorded on the cathode-ray tube. The initial x and y coordinates of the path are arbitrarily assumed to coincide with the reference axis.

The technique can in fact be applied in the case of a target profile of any shape since any curve can be defined by juxtaposition of small elementary segments. An effect of remoteness from the target can be produced by means of a homothetic variation in dimensions of the segments. If so required, it is also possible to obtain a similar effect by varying the light intensity of the luminous point from one image to the next. A variation in intensity during one and the same path makes it possible to produce a relief effect.

The entire electronic equipment employed in the foregoing for simulating a fictitious target within the field of view of the sighting device can also be employed at the same time and in the same manner for representing the path of the projectile, the sighting reticle, the effects of impact on the target or on the ground. Furthermore, this simulation by electronic equipment is adaptable both to representation of one or a plurality of projectiles, whether they consist of ballistic projectiles or missiles, as well as to representation of one or a plurality of targets which can be highly diversified in shape, dimensions and displacement independently of each other. It will also have become apparent that the simulator herein described can be adapted to both indoor training and to open-air training in real field conditions.

Figure 4:
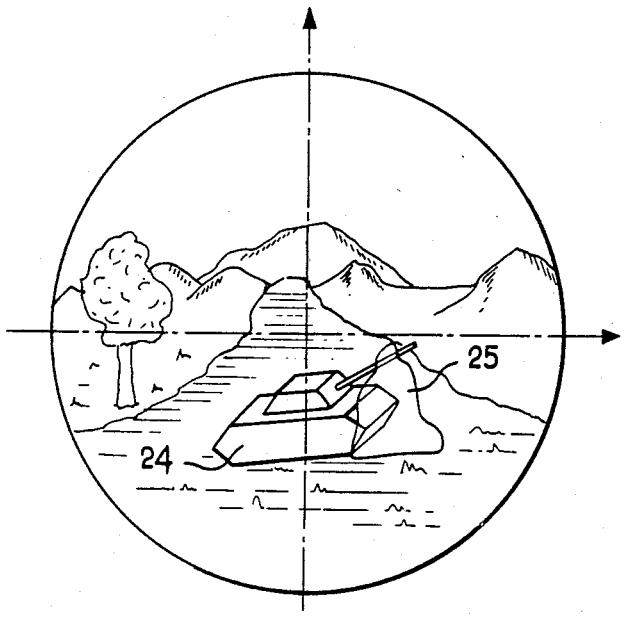
FIG. 4 shows another example of image presented for viewing by the firer.
Figure 5:
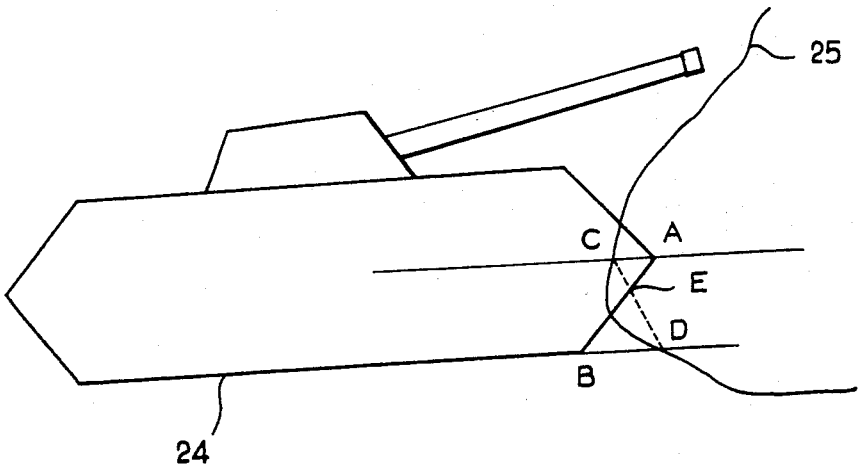
FIG. 5 illustrates the correction of a fictitious target by means of a mask.

In the alternative embodiment illustrated in FIGS. 4 and 5, provision has also been made for the possibility of varying the target signals and the representation of successive images of the fictitious target as a function of the terrain observed by the sighting field and of obstacles which would be encountered by a real target corresponding to said fictitious target. This signal variation is carried out by producing an extinction of the luminous point on predetermined portions of its path. It is for this reason that there are shown in FIG. 3 in dashed lines the grid 21 of the cathode-ray tube as well as a line 22 for connecting the computer 15 to said grid in order to initiate emission and extinction of the cathode-ray beam. Determination of the portions of the path on which extinction is intended to take place entails the need for a comparison performed in the computer 15 between the data relating to the target and pre-recorded data defining the terrain and its obstacles. The pre-recorded data are fed into the computer at 23.

The recording operation is usually performed by the instructor prior to firing. It is thus possible to record terrain data from a topographic survey carried out in accordance with any known method, in which each point of the terrain is determined in the terrain data by the distance of that point with respect to the weapon and its angular position with respect to the line of sight, usually in elevation and in azimuth. By way of example, U.S. Pat. No. 4,068,393 describes the storage of terrain data by means of a method which utilizes a simplified representation of the terrain.

Recording of said terrain data can be carried out at any moment on a magnetic medium, if necessary a considerable length of time prior to the firing period. In order to permit superimposition of the recorded terrain on the real terrain observed by the firer during the training session, the instructor initializes the simulator by accurate optical sighting on a reference landmark which has been specially chosen.

In accordance with another method which will be described in greater detail hereinafter, obstacles which are visible on the real field of fire are recorded directly by means of the unit. In the case of each obstacle which is liable to conceal the target, a mask is defined by its distance from the weapon and by its external contour in angular position with respect to the line of sight. This is illustrated with reference to FIG. 4 in which images are displayed for viewing by the firer and comprise on the one hand a fictitious target representing a tank 24 and on the other hand a real field of fire or land area comprising among other features an obstacle 25 consisting of a tree, for example, from which a mask is defined.

Each mask is considered as a surface having any contour and located at a given distance determined visually by the instructor or by telemetry. The contour is defined by making use of a moving index generated in the optical sight of the system (controllable luminous point generated by the flying-spot cathode-ray tube, for example). The outer contour of the mask observed in the field of fire is described by means of said moving index. The computer continously stores the coordinates of the luminous point. When the contour has been completely described, the value of the mark distance (md) is given to said contour. The computer processes the recorded values and draws up a table in which values of abscissa Xm(k,1) which are characteristic of the appearance of the mask are associated with each value of ordinate Ym(k).

The masks are recorded one after the other during the same manipulation. The line of sight of the simulator telescopic sight through which said masks are visible is stationary and pointed at a specific known landmark which is located at any predetermined distance (and may already exist in the firing area or which may be added, such as a post driven into the ground). It will be noted, however, that only relatively close obstacles are recorded, and not obstacles of no interest which are located beyond the range of travel of the fictitious target or targets.

Should it be desired to record a mask from an obstacle located outside the field of the telescopic sight since it is nevertheless within the operating zone of the fictitious target or targets, it can be recorded by displacing the field of the telescopic sight by a known value with respect to the landmark.

Recordings are carried out prior to instruction sessions and stored on a nonvolatile medium such as magnetic tape cassettes or cartridges. At the time of an instruction session, said recordings are restituted to the computer memory and initialization on the precise landmark is performed in order to ensure correct superimposition of the recorded masks on the real obstacles both in elevation and in azimuth.

After processing, each mask is therefore stored in memory in the form of a distance dm and of a series of addresses Ym and of data Xm characterizing the points of the contour and therefore the ends of ordinate segments Ym separated by a pitch (p) which is as small as possible (approximately 0.5 mrd).

This table of data is utilized in order to produce mask signals which serve to correct the target signals defining the segments of the target images.

Thus, after computation of the segments of the fictitious target, the computer determines the nearest mask whose distance dm is shorter than the distance dc of the target with respect to the weapon, and the segments whose ends are within the interior of the mask.

By way of example in the case of a segment i whose ends A and B are defined by the coordinates ($Xi_1$, $Yi_1$) and ($Xi_2$, $Yi_2$):

when $Yi_1 = Ym(k)$, is $Xm(k,1) < Xi_1 < Xm(k,2)$?

when $Yi_2 = Ym(r)$, is $Xm(r,1) < Xi_2 < Xm(r,2)$?

Should this not be the case, the segment will be entirely generated. Should this in fact be the case, then the segment will be partly displayed (if one of the two conditions is satisfied) or totally concealed (if both conditions are satisfied).

In the event that the segment is partly displayed, the segment (i) is divided in that case into two sub-segments, only one of which will be displayed, namely the sub-segment located outside the mask. The common end of the two sub-segments is computed in its coordinates so as to correspond to the point of intersection between the target segment AB considered and the chord which joins the two points C and D of the contour of the mask having the same address (or ordinate) as the ends of the segment, namely E (FIG. 5). In consequence, there may be a slight overlap of the visible segment on the mask but this does not have any objectionable effect on the simulation.

The successive segments (and sub-segments) of the target are all defined and generated at the level of the cathode-ray tube deflection control (coils 17, 18), whether they are visible or not. At the time of generation of a visible segment, control of the grid 21 enables the electron beam to impinge upon the phosphor-coated screen. At the time of generation of a non-visible segment, the grid control blocks the electron beam.

It will be noted that the technique described in the foregoing for masking all or part of the targets is wholly applicable to masking of projectiles, missiles and impacts.

As will naturally be understood and as has already become apparent from the foregoing, the invention is not limited in any sense either to the particular embodiment hereinabove described by way of example or to the variants which have been mentioned. Many other variants may be contemplated in regard to the design concept of each element of the training unit without thereby departing either from the scope or the spirit of the invention.

What is claimed is:

1. A training unit for aiming at targets and having an orientable line of sight, comprising means for forming the image of a fictitious target in the field of view of said unit, wherein said image-forming means comprises a screen for visual display of luminous images, means for generating target signals in order to produce target signals defining successive images of a fictitious non-pointlike target as a function of the shape and continuous relative displacement of said target at least in distance from the unit and/or in angular position with respect to the line of sight, means for causing the displacement of a luminous point on the screen by means of said signals in order to display each of the images thus defined on said screen, and means for projecting the images thus formed in the field of view of the unit, the speed of displacement of the luminous point being sufficient to ensure persistence of perception of said point throughout the time required for forming an image, said means for generating target signals comprising a computer for producing said successive images in the form of a series of linear segments and for delivering in respect of each segment three values corresponding respectively to the time derivatives of two rectangular coordinates defining the position of the luminous point and to the time of displacement of the said luminous point at a predetermined speed for describing said segment.

2. A training unit according to claim 1, wherein said means for controlling the displacement of the luminous point on the screen comprise an interface for processing the signals produced by the computer in order to generate signals for controlling the displacement of the luminous point at said predetermined speed in accordance with said rectangular coordinates by integration of the two corresponding derivatives during said time interval.

3. A training unit according to claim 1, wherein said unit is mounted on a weapon for aiming at fictitious targets and firing fictitious projectiles in a firing simulator comprising means for comparison between the respective positions of the fictitious projectile and the fictitious target in order to appreciate the results of the fictitious shot which has been fired.

4. A training unit according to claim 1, wherein said screen is the screen of a cathode-ray tube in which the electron beam is deflected under the control of said target signals.

5. A training unit according to claim 1, wherein said unit further comprises means for comparison between said target signals and pre-recorded mask signals providing the distance and the angular position of obstacles located on the terrain and means for controlling extinction of the luminous point as a function of said comparison when the distance defined by the target signals is greater than the distance defined by the mask signals in respect of an angular position located within the mask contour.

6. A training unit in accordance with claim 1, wherein said unit comprises means for modifying the target signals from one image to the next under the control of pre-recorded terrain data.

7. A method of formation of a fictitious target in a training unit for aiming at targets and providing an orientable line of sight, comprising producing target signals defining successive images of a fictitious non-pointlike target as a function of the shape and continuous relative displacement of said target at least in distance from the training unit and/or in angular position with respect to the line of sight; forming each successive target image thus defined by means of a luminous point displaced on a screen under the control of said target signals; and projecting the successive images thus formed in the field of view of said unit, the speed of displacement of the luminous point being sufficiently high to ensure persistence of perception of said point throughout the time required for formation of an image; each target image being defined in said target signals by a plurality of linear segments and wherein displacement of the luminous point is controlled as a function of said target signals along a linear path comprising at least the linear segments with a continuous light intensity along said segments, at least some of the linear segments being rectilinear segments, and wherein for each rectilinear segment, the target signals contain items of information in which the length of the segment is represented by the time of displacement of the luminous point at a predetermined speed for describing the segment and in which the angular slope of the segment is represented by the time derivatives of two rectangular coordinates which define the position of said luminous point.

8. A method according to claim 7, wherein signals for controlling the displacement of the luminous point at said predetermined speed are produced from the target signals aforesaid in accordance with said rectangular coordinates by integration of the two corresponding derivatives during said time interval.

9. A method according to claim 7, wherein each image is formed by displacement of the luminous point at a sufficient speed to ensure that the time required for each image is shorter than the time of persistence of retinal images and wherein the images succeed each other at a sufficiently high rate with respect to the image retention of the screen to ensure luminous persistence on the screen from one image to the next.

10. A method according to claim 7, wherein said method further comprising recording mask signals from obstacles defined on a terrain by at least their distance and their contour in angular position with respect to the line of sight, in comparing the target signals with said mask signals, and in respect of each target image in producing extinction of the luminous point on those portions of the path in which the given distance in the target signals is greater than that of the mask in respect of an angular position located within the contour of said mask.

* * * * *